US011361652B1

(12) United States Patent
Nye

(10) Patent No.: US 11,361,652 B1
(45) Date of Patent: Jun. 14, 2022

(54) VOICE ANNUNCIATED REMINDERS AND ALERTS

(71) Applicant: Vivint, Inc., Provo, UT (US)

(72) Inventor: James Ellis Nye, Alpine, UT (US)

(73) Assignee: VIVINT, INC., Provo, UT (US)

( * ) Notice: Subject to any disclaimer, the term of this patent is extended or adjusted under 35 U.S.C. 154(b) by 30 days.

(21) Appl. No.: 16/397,432

(22) Filed: Apr. 29, 2019

Related U.S. Application Data

(63) Continuation of application No. 14/561,098, filed on Dec. 4, 2014, now Pat. No. 10,276,026.

(60) Provisional application No. 61/912,952, filed on Dec. 6, 2013.

(51) Int. Cl.
*G08B 21/24* (2006.01)
*G08B 25/01* (2006.01)
*G08B 3/10* (2006.01)

(52) U.S. Cl.
CPC ..... *G08B 21/24* (2013.01); *G08B 3/1016* (2013.01); *G08B 25/016* (2013.01)

(58) Field of Classification Search
CPC ..... G06F 3/163; G06F 3/167; G06Q 10/10; G06Q 10/107; G06Q 10/109; G06Q 10/20; G08B 3/1016; G08B 5/222; G08B 5/36; G08B 21/18; G08B 21/24; G08B 25/016; G08B 25/10; G08B 29/02; G08B 29/26; H04M 1/656; H04M 3/42051; H04W 4/90
USPC ..... 340/691
See application file for complete search history.

(56) References Cited

U.S. PATENT DOCUMENTS 4,072,825 A 2/1978 McLay et al.
6,563,430 B1 5/2003 Kemink et al.
7,113,090 B1 * 9/2006 Saylor ..... G08B 13/19682 340/5.33
7,260,221 B1 8/2007 Atsmon
8,972,558 B1 3/2015 Horton
8,988,232 B1 * 3/2015 Sloo ..... G01N 27/121 340/602
2002/0147524 A1 * 10/2002 Nickum ..... G08B 1/08 700/204
2002/0186618 A1 * 12/2002 Kirkpatrick ..... G04G 13/021 368/11
2004/0043760 A1 * 3/2004 Rosenfeld ..... H04L 67/18 455/414.3
2004/0119600 A1 6/2004 Hampton
2005/0009508 A1 * 1/2005 Graske ..... H04M 3/487 455/414.3
2005/0099299 A1 5/2005 Tyroler et al.
2005/0240680 A1 10/2005 Costa-Requena et al.
2006/0123053 A1 * 6/2006 Scannell ..... G06F 16/9577
2007/0001512 A1 1/2007 Sato et al.
2008/0130520 A1 6/2008 Ebrom et al.
2010/0019899 A1 1/2010 Zhang et al.
2010/0157990 A1 6/2010 Krzyzanowski et al.
2010/0260173 A1 10/2010 Johnson
2010/0333135 A1 12/2010 Lau et al.
(Continued)

*Primary Examiner* — Stephen R Burgdorf
(74) *Attorney, Agent, or Firm* — Kunzler Bean & Adamson, PC

(57) ABSTRACT

A computer-implemented method for announcing reminders and alerts is described. In one embodiment, appointments of an electronic calendar are monitored via a processor of a home automation system. A trigger of an upcoming appointment is detected. Information regarding the upcoming appointment is announced via a speaker of the home automation system.

19 Claims, 7 Drawing Sheets

(56) References Cited

U.S. PATENT DOCUMENTS

| | | | | |
|---|---|---|---|---|
| 2011/0102134 | A1 | 5/2011 | Venkatesan et al. | |
| 2011/0231419 | A1 | 9/2011 | Papke et al. | |
| 2011/0241877 | A1 | 10/2011 | Wedig et al. | |
| 2012/0192358 | A1 | 8/2012 | Katan | |
| 2012/0197523 | A1* | 8/2012 | Kirsch | H04M 1/72451 701/426 |
| 2013/0090744 | A1 | 4/2013 | Tran | |
| 2013/0135108 | A1* | 5/2013 | Alameh | G08B 21/24 340/575 |
| 2013/0324071 | A1* | 12/2013 | Huh | H04W 4/90 455/404.1 |
| 2014/0206391 | A1 | 7/2014 | Perotti | |
| 2014/0266669 | A1 | 9/2014 | Fadell et al. | |
| 2014/0309868 | A1 | 10/2014 | Ricci | |
| 2014/0373099 | A1* | 12/2014 | Durbha | H04L 63/10 726/4 |
| 2015/0096876 | A1* | 4/2015 | Mittleman | H04N 5/77 200/341 |
| 2015/0134330 | A1* | 5/2015 | Baldwin | G06V 40/172 704/232 |
| 2015/0156031 | A1 | 6/2015 | Fadell et al. | |

* cited by examiner

VOICE ANNUNCIATED REMINDERS AND ALERTS

CROSS REFERENCE

The present application us a continuation of U.S. patent application Ser. No. 14/561,098, filed Dec. 4, 2014, titled "VOICE ANNUNCIATED REMINDERS AND ALERTS", which claims priority to U.S. Provisional Patent Application No. 61/912,952, filed Dec. 6, 2013, titled "VOICE ANNUNCIATED REMINDERS AND ALERTS," and assigned to the assignee hereof, the disclosure of these references is incorporated herein in their entirety by this reference.

BACKGROUND

Advancements in media delivery systems and media-related technologies continue to increase at a rapid pace. Increasing demand for media has influenced the advances made to media-related technologies. Computer systems have increasingly become an integral part of the media-related technologies. Computer systems may be used to carry out several media-related functions. The wide-spread access to media has been accelerated by the increased use of computer networks, including the Internet and cloud networking.

Many homes and businesses use one or more computer networks to generate, deliver, and receive data and information between the various computers connected to computer networks. Users of computer technologies continue to demand increased access to information and an increase in the efficiency of these technologies. Improving the efficiency of computer technologies is desirable to those who use and rely on computers.

With the wide-spread use of computers and mobile devices has come an increased capability to maintain calendars and provide automated alerts for users. Users of mobile devices, however, may not have a mobile device near them while in a home or building. As a result, calendaring items and/or alerts provided by mobile devices may be undetected by the user.

SUMMARY

According to at least one embodiment, a computer-implemented method for announcing reminders and alerts is described. In one embodiment, appointments of an electronic calendar may be monitored via a processor of a home automation system. A trigger of an upcoming appointment may be detected. Information regarding the upcoming appointment may be announced via a speaker of the home automation system.

In one embodiment, an emergency alert system may be required and, as a result, emergency information may be received from the emergency alert system. An alert may be announced via the speaker based on the emergency information received from the emergency alert system. Similarly, a web-based calendar system may be queried, and calendar information may be received from the web-based calendar system. A mobile device calendar system may be queried, and calendar information may be received from the mobile device calendar system. Calendar information may be received from a user interfacing with a user interface of the home automation system. In any case, calendar information may be stored in a storage device of the home automation system.

In some embodiments, information regarding the upcoming appointment may be received at the speaker. The information regarding the upcoming appointment may be stored in a storage device at the speaker. In one embodiment, the home automation system may determine whether a room associated with the speaker is occupied. Upon determining the room associated with the speaker is occupied, information regarding the upcoming appointment may be announced via the speaker. Upon determining the room associated with the speaker is not occupied, the announcement of information regarding the upcoming appointment may be blocked. In some cases, upon determining the room associated with the speaker is occupied, the identity of a person occupying the room may be determined. Upon determining the identified person is associated with the upcoming appointment, information regarding the upcoming appointment may be announced via the speaker.

A computing device configured to obscure content on a screen is also described. The device may include a processor and memory in electronic communication with the processor. The memory may store instructions that may be executable by the processor to monitor, via a processor of a home automation system, appointments of an electronic calendar, detect a trigger of an upcoming appointment, and announce, via a speaker of the home automation system, information regarding the upcoming appointment.

A computer-program product to obscure content on a screen is also described. The computer-program product may include a non-transitory computer-readable medium that stores instructions. The instructions may be executable by the processor to monitor, via a processor of a home automation system, appointments of an electronic calendar, detect a trigger of an upcoming appointment, and announce, via a speaker of the home automation system, information regarding the upcoming appointment.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
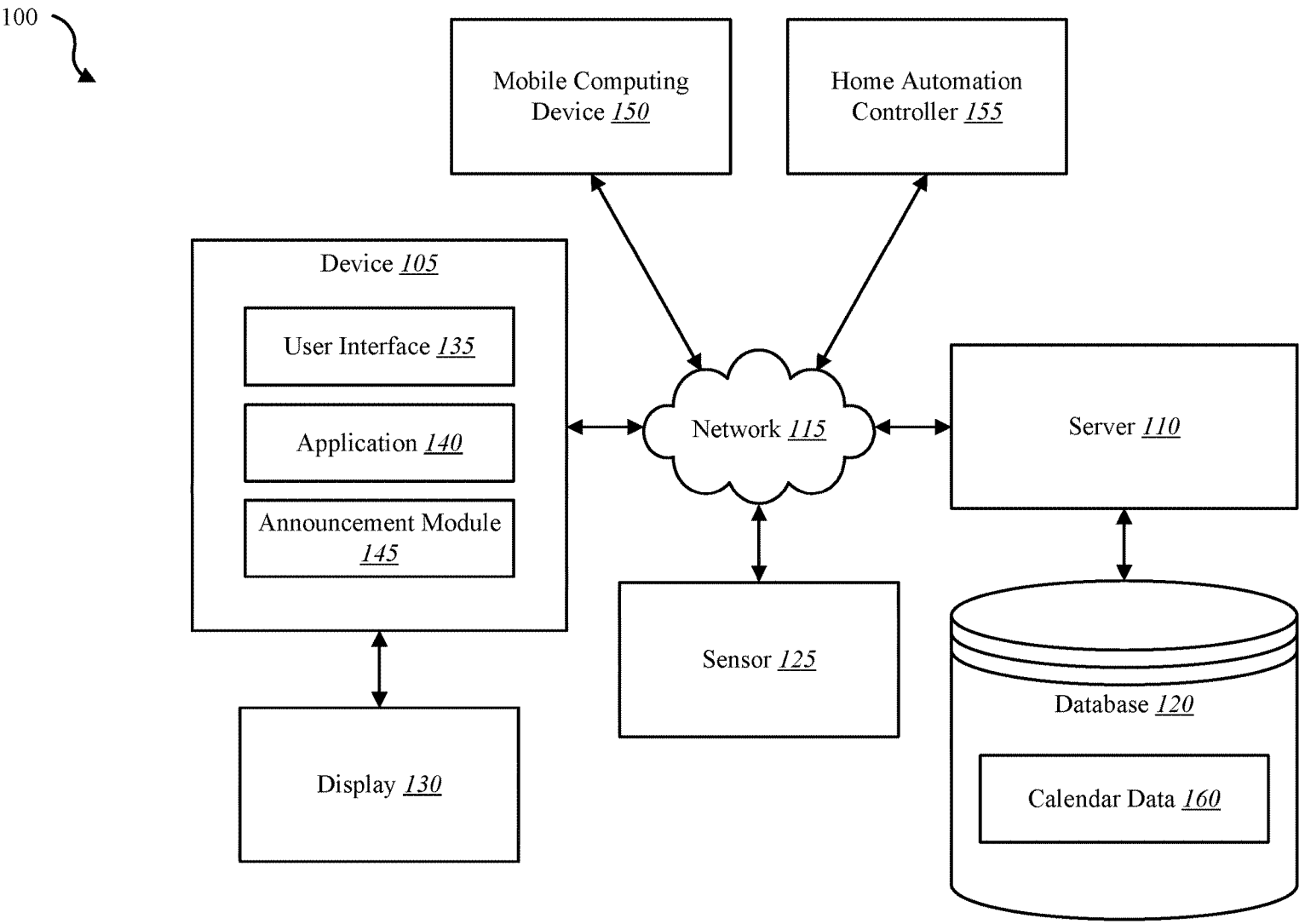
FIG. 1 is a block diagram illustrating one embodiment of an environment in which the present systems and methods may be implemented.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The systems and methods described herein relate to home automation. More specifically, the systems and methods described herein relate to announcing reminders and alerts in relation to a home automation system. In one example, a user may desire to receive a reminder as an upcoming appointment approaches. Additionally, or alternatively, a user may desire to receive an alert and/or warning regarding a situation in or outside a home or building. For example, a user may desire to receive an alert regarding a home or building. For instance, in addition to wanting to receive announcements over a speaker in the home regarding upcoming appointments, a homeowner may want to receive alerts regarding conditions in the home, warnings regarding severe weather alerts, and the like.

FIG. 1 is a block diagram illustrating one embodiment of an environment 100 in which the present systems and methods may be implemented. In some embodiments, the systems and methods described herein may be at least partially performed on a device (e.g., device 105). The environment 100 may include a device 105, server 110, a sensor 125, a display 130, a mobile computing device 150, a home automation controller 155, and a network 115 that allows the device 105, the server 110, the mobile computing device 150, home automation controller 155, and sensor 125 to communicate with one another. Examples of the device 105 include media content set top box, satellite set top box, cable set top box, DVRs, personal video recorders (PVRs), mobile devices, smart phones, personal computing devices, computers, servers, etc. Examples of the home automation controller 155 include a dedicated home automation computing device (e.g., wall-mounted controller), a personal computing device (e.g., laptop, desktop, etc.), a mobile computing device (e.g., tablet computing device, smartphone, etc.), and the like.

Examples of sensor 125 include a camera sensor, audio sensor, proximity sensor, boundary sensor, light beam sensor, three-dimensional (3-D) sensor, motion sensor, door sensor, window sensor, accelerometer, global positioning system (GPS) sensor, Wi-Fi positioning system sensor, capacitance sensor, radio frequency sensor, near-field sensor, voice sensor, and the like. Sensor 125 may represent one or more separate sensors or a combination of two or more sensors in a single device. For example, sensor 125 may represent one or more camera sensors and one or more motion sensors connected to the devices of environment 100 and/or network 115. Additionally, or alternatively, sensor 125 may represent a combination sensor such as both a camera sensor and a motion sensor integrated in the same device. Sensor 125 may be integrated with a facial recognition system. Although sensor 125 is depicted as connecting to device 105 over network 115, in some embodiments, sensor 125 may connect directly to device 105 and/or other devices of environment 100.

Additionally, or alternatively, sensor 125 may be integrated with a home appliance or fixture such as a light bulb fixture. Sensor 125 may include an accelerometer to enable sensor 125 to detect a movement. Sensor 125 may include a wireless communication device enabling sensor 125 to send and receive data and/or information to and from one or more devices in environment 100. Additionally, or alternatively, sensor 125 may include a GPS sensor to enable sensor 125 to track a location of sensor 125. Sensor 125 may include a proximity sensor to detect the proximity of a person relative to an object to which the sensor is attached and/or an area to which the sensor associated.

In some configurations, the device 105 may include a user interface 135, application 140, and announcement module 145. Although the components of the device 105 are depicted as being internal to the device 105, it is understood that one or more of the components may be external to the device 105 and connect to device 105 through wired and/or wireless connections. In some embodiments, application 140 may be installed on mobile computing device 150 in order to allow a user to interface with a function of device 105, announcement module 145, home automation controller 155, and/or server 110.

In some embodiments, device 105 may communicate with server 110 via network 115. Examples of networks 115 include cloud networks, local area networks (LAN), wide area networks (WAN), virtual private networks (VPN), wireless networks (using 802.11, for example), cellular networks (using 3G and/or LTE, for example), short-range wireless mesh networks (e.g., Z-WAVE®, ZIGBEE®, BLUETOOTH® Low Energy, etc.), and the like. In some configurations, the network 115 may include the internet.

It is noted that in some embodiments, the device 105 may not include an announcement module 145. For example, device 105 may include application 140 that allows device 105 to interface with home automation controller 155 via announcement module 145 located on another device such as mobile computing device 150 and/or server 110. In some embodiments, device 105, home automation controller 155, and server 110 may include an announcement module 145 where at least a portion of the functions of announcement module 145 are performed separately and/or concurrently on device 105, home automation controller 155, mobile computing device 150, and/or server 110. Likewise, in some embodiments, a user may access the functions of device 105 and/or home automation controller 155 (directly or through device 105 via announcement module 145) from mobile computing device 150. For example, in some embodiments, mobile computing device 150 includes a mobile application that interfaces with one or more functions of device 105, home automation controller 155, announcement module 145, and/or server 110. In some embodiments, at least a portion of the functions of the announcement module 145 may execute on one or more devices located in a cloud network, including any one of the devices illustrated in FIG. 1. For example, one or more computing devices may connect to and communicate with a home automation controller in a home over a cloud network. Thus, one or more functions of the announcement module 145 may be performed on one or more devices in a cloud network. Performance of the function by the one or more devices in the cloud network may include interacting, controlling an aspect of, and/or communicating with one or more devices in the home via the home automation controller 155.

In some embodiments, server 110 may be coupled to database 120. Database 120 may include calendar data 160 and other information related to appointments, reminders, alerts, warnings, etc. For example, device 105 may access calendar data 160 in database 120 over network 115 via server 110. Database 120 may be internal or external to the server 110. Additionally, or alternatively, calendar data 160 may be stored locally at the device 105, on a mobile computing device 150, and/or home automation controller 155. In one example, device 105, mobile computing device 150, and/or home automation controller 155 may be coupled directly to database 120, database 120 being internal or external to device 105, mobile computing device 150, and/or home automation controller 155. Calendar data may include information regarding appointments and reminders a user creates via user interface 135 on device 105, via a calendar application on mobile computing device 150, a web-based calendar (e.g., GOOGLE® Calendar application, etc.), and/or a user interface of home automation controller 155. Additionally, or alternatively, database 120 may store data regarding warnings regarding weather, traffic, emergencies, and the like.

In one embodiment, announcement module 145 may announce reminders and alerts in relation to a home automation system. For example, announcement module 145 may announce a reminder as an upcoming appointment approaches. Announcement module 145 may provide announcements over a speaker in the home regarding upcoming appointments. Additionally, or alternatively, announcement module 145 may announce an alert and/or a warning regarding a situation in or outside a home or building. For example, a user may desire to receive an alert regarding certain situations that may occur in a home or building, warnings regarding severe weather alerts, and the like. Further details regarding the announcement module 145 are provided below.

Figure 2:
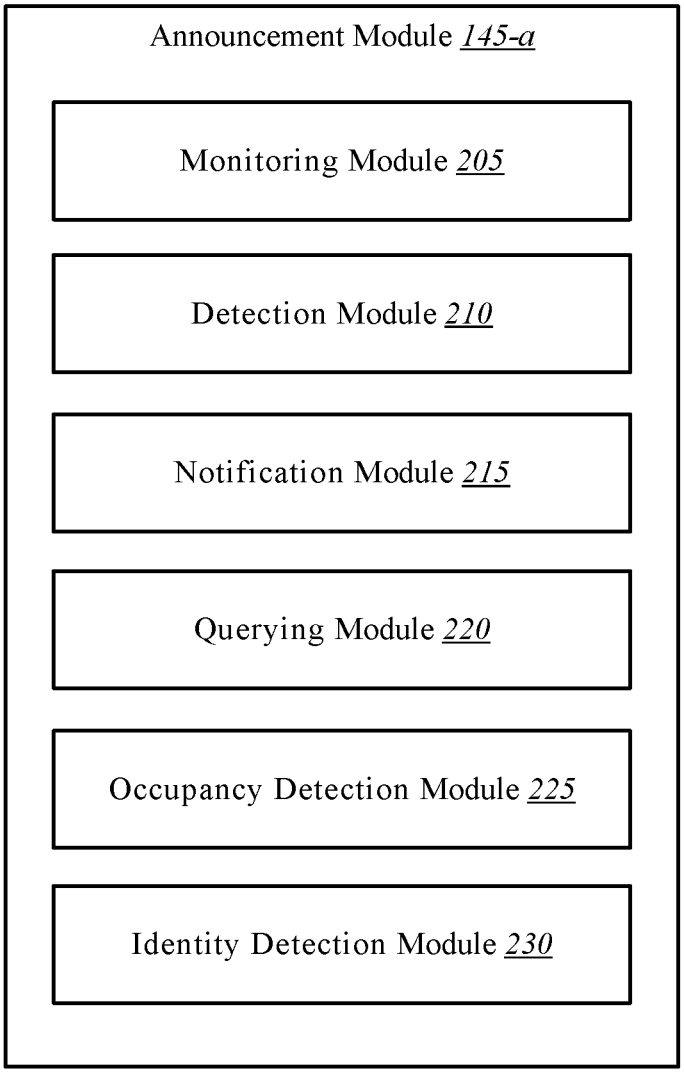
FIG. 2 is a block diagram illustrating one example of an announcement module.

FIG. 2 is a block diagram illustrating one example of an announcement module 145-*a*. Announcement module 145-*a* may be one example of announcement module 145 depicted in FIG. 1. As depicted, announcement module 145-*a* may include monitoring module 205, detection module 210, notification module 215, querying module 220, occupancy detection module 225, and identify detection module 230.

In one embodiment, monitoring module 205 may monitor appointments of an electronic calendar. For example, monitoring module 205 may monitor the calendar data 160 stored in database 120. Additionally, or alternatively, monitoring module 205 may monitor calendar data on mobile computing device 150, calendar data on a personal computer, a web-based calendar, and the like. Based on the monitored calendar data, detection module 210 may detect a trigger of an upcoming appointment. For example, in some cases, a user may specify a reminder to be announced a predetermined time before the appointment's scheduled time. In some cases, monitoring module 205 and detection module 210 automatically trigger the announcement of a reminder based on an upcoming appointment, regardless whether the user specifies a reminder. Accordingly, notification module 215 may announce, via a speaker of a home automation system, information regarding the upcoming appointment.

In some embodiments, querying module 220 may query a calendar to create new appointments and reminders, to synchronize existing appointments, to update changes to existing appointment, and to trigger reminders regarding upcoming appointments. Querying module 220 may query calendars from one or more external calendar systems. Thus, querying module 220 may query one or more calendars on mobile device 150, web-based calendars, cloud-based calendars, appointments and reminders a user enters at the home automation controller 155 (e.g., manual entry, voice entry, gesture entry, mobile device interfacing with the home automation controller, personal computer interfacing with the automation controller, etc.), and one or more calendars stored in database 120. In response, announcement module 145-*a* may receive calendar information from the queried calendars. Announcement module 145-*a* may store calendar information in a storage device of the home automation system (e.g., database 120).

In some embodiments, announcement module 145-*a* may send information regarding the upcoming appointment to a speaker located in a home or building. The speaker may include memory to store the appointment and logic to configure and provide announcements. In some cases, the speaker may include one or more components of announcement module 145-*a*. In one embodiment, announcement module 145-*a* may store the information regarding the upcoming appointment in a storage device located at the speaker.

In one embodiment, occupancy detection module 225 may determine whether a room associated with the speaker is occupied. For example, in conjunction with sensor 125, occupancy detection module 225 may determine whether a person is in a particular room. In some cases, occupancy detection module 225 may be integrated with a speaker in a room. Upon determining the room associated with the speaker is occupied, notification module 215 may announce, via the speaker, information regarding the upcoming appointment. Upon determining the room associated with the speaker is not occupied, announcement module 145-*a* may block the information regarding the upcoming appointment from being announced in the unoccupied room. In some embodiments, upon determining the room associated with the speaker is occupied, identity detection module 230 may determine the identity of the person occupying the room. Upon determining the identified person is associated with an upcoming appointment, notification module 215 may announce, via the speaker, information regarding the upcoming appointment. In some embodiments, upon determining the identified person is not associated with the upcoming appointment, announcement module 145-*a* may block the information regarding the upcoming appointment from being announced in the room occupied by the identified person.

In one embodiment, querying module 220 may query an emergency alert system. A user may desire to receive an alert regarding a home or building via a home automation and/or security system. Accordingly, detection module 210 may detect certain building or home conditions and announce alerts regarding the detected building/home conditions (e.g., fire alarm, flooding, carbon monoxide, appliance failure, temperature anomalies, etc.). Additionally, or alternatively, querying module 220 may query one or more emergency alert systems providing information regarding weather conditions (e.g., weather forecasts, weather anomalies, severe weather, etc.), traffic conditions (e.g., traffic patterns, traffic jams, construction, etc.), earthquakes, biological emergencies, chemical emergencies, radiological emergencies, child abduction emergencies, and the like. Upon receiving emergency information from an emergency alert system, notification module 215 may announce, via the speaker, an alert based on the emergency information received from the emergency alert system.

Figure 3:
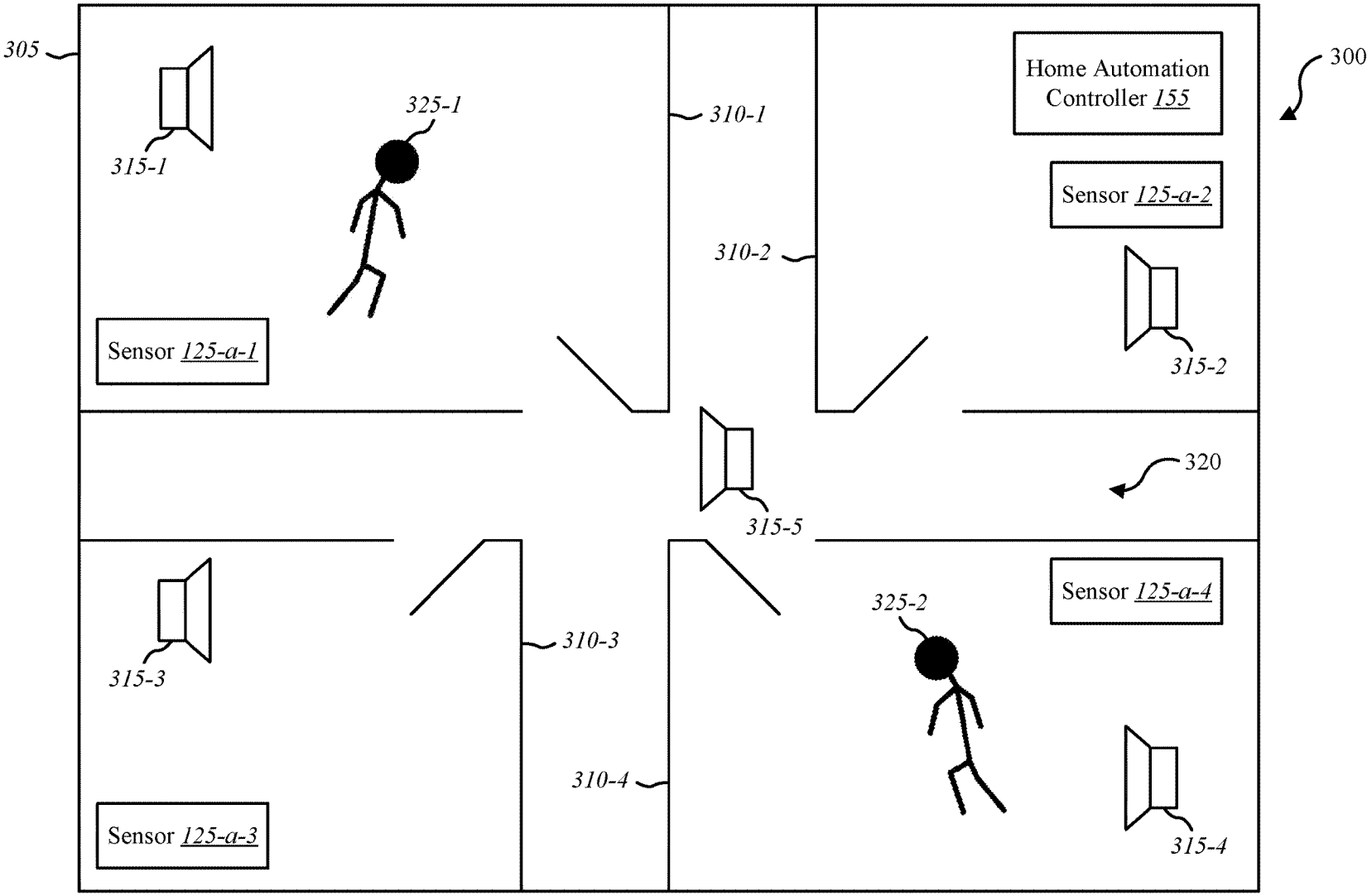
FIG. 3 is a block diagram illustrating one example of an environment for making announcements using a home automation system.

FIG. 3 is a block diagram illustrating one example of an environment 300 for making announcements using a home automation controller 155. As depicted, the area 305 (e.g., a home or building) may include one or more rooms. For example, a home or building may include rooms 310-1, 310-2, 310-3, and 310-4, as well as a central area 320 (e.g., a hallway, an entry way, an reception area, etc.). As depicted, home automation controller 155 may be located in one of the rooms. Each room may include a speaker through which announcements may be made. For example, room 310-1 may include speaker 315-1, room 310-2 may include speaker 315-2, room 310-3 may include speaker 315-3, and room 310-4 may include speaker 315-4. Certain rooms may be occupied. For example, at one point user 325-1 may occupy room 310-1. Additionally, or alternatively, user 325-2 may occupy room 310-4. In some embodiments, each room may include one or more sensors communicatively coupled to home automation controller 155. For example, room 310-1 may include sensor **125-*a*-1, room 310-2 may include sensor 125-*a*-2, room 310-3 may include sensor 125-*a*-1-3, and room 310-4 may include sensor 125-*a*-1-4**. In some embodiments, sensors in each room may be integrated with the speakers.

As depicted, sensor **125-*a*-1 may detect user 325-1 in room 310-1. Similarly, sensor 125-*a*-4 may detect user 325-2 in room 310-4. In one embodiment, a user may enter calendar data at the home automation controller 155 and/or a user interface in one of the rooms of the area 305. In one example, calendar data may be transmitted wirelessly from a mobile device to the home automation controller 155**.

In some cases, a speaker may include a microphone that is communicatively connected to home automation controller 155. Thus, user 325-1 may generate an appointment by audibly stating details regarding an appointment to the home automation controller 155 via the microphone, and the home automation controller 155 may generate and store the appointment by processing the received details of the appointment. Home automation controller 155, via announcement module 145, may recognize the identity of user 325-1 and associate the generated appointment with the identity of user 325-1. Additionally, or alternatively, home automation controller 155, in conjunction with announcement module 145, may query a calendar associated with user 325-1 and/or 325-2.

Based on a predetermined time before the occurrence of an appointment, home automation controller 155, in conjunction with announcement module 145, may audibly announce as a reminder details regarding the upcoming appointment. For example, home automation controller 155, in conjunction with announcement module 145, may determine that only rooms 310-1 and 310-4 are occupied. Accordingly, home automation controller 155, in conjunction with announcement module 145, may audibly announce the reminder in rooms 310-1 and 310-4, but not in rooms 310-2 and 310-3. In some embodiments, home automation controller 155, in conjunction with announcement module 145, may determine that a particular upcoming appointment is associated with user 325-2 and not with user 325-1. Accordingly, upon determining that user 325-2 is located in room 310-4, home automation controller 155, in conjunction with announcement module 145, may audibly announce the reminder in room 310-4 only, and not in rooms 310-1, 310-2, or 310-3. Additionally, or alternatively, home automation controller 155, in conjunction with announcement module 145, may query an emergency alert system and receive information regarding an alert of some sort. Accordingly, home automation controller 155, in conjunction with announcement module 145, may make an emergency announcement in all the rooms, including the central area 320.

Figure 4:
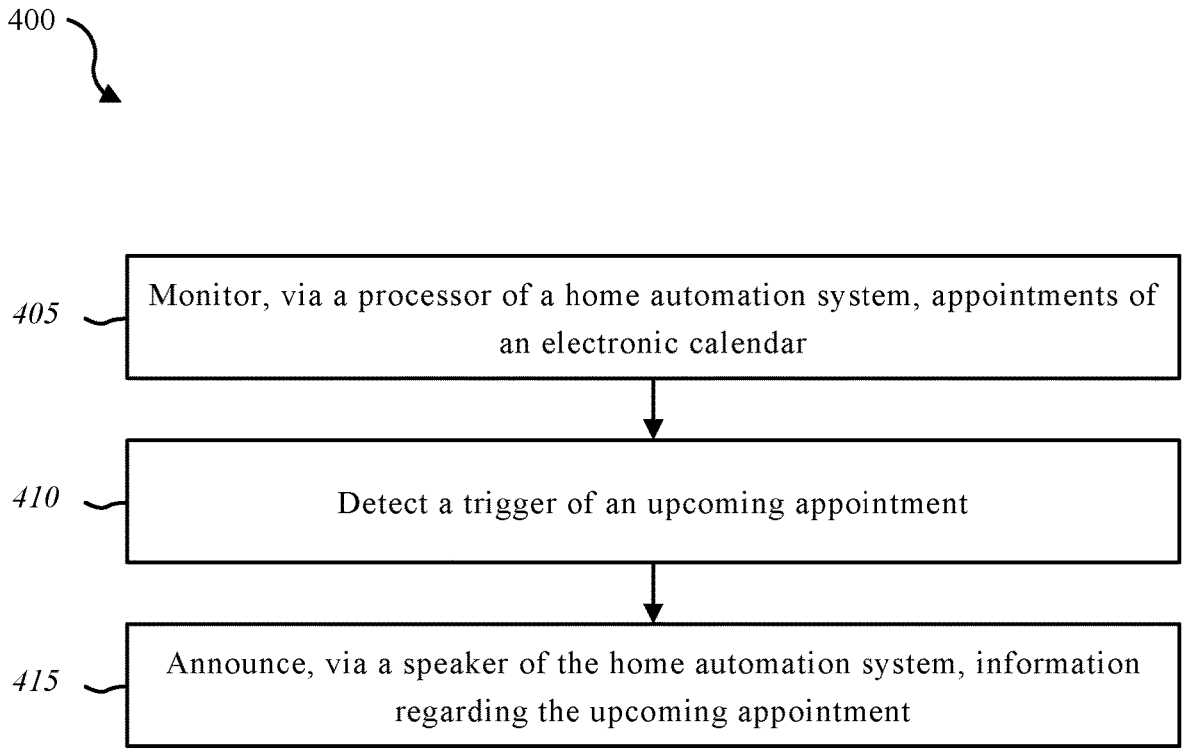
FIG. 4 is a flow diagram illustrating one embodiment of a method for announcing reminders and alerts.

FIG. 4 is a flow diagram illustrating one embodiment of a method 400 for announcing reminders and alerts. In some configurations, the method 400 may be implemented by the announcement module 145 illustrated in FIGS. 1 and/or 2. In some configurations, the method 400 may be implemented in conjunction with the application 140 and/or the user interface 135 illustrated in FIG. 1.

At block 405, appointments of an electronic calendar may be monitored via a processor of a home automation system. At block 410, a trigger of an upcoming appointment may be detected. At block 415, information regarding the upcoming appointment may be announced via a speaker of the home automation system.

Figure 5:
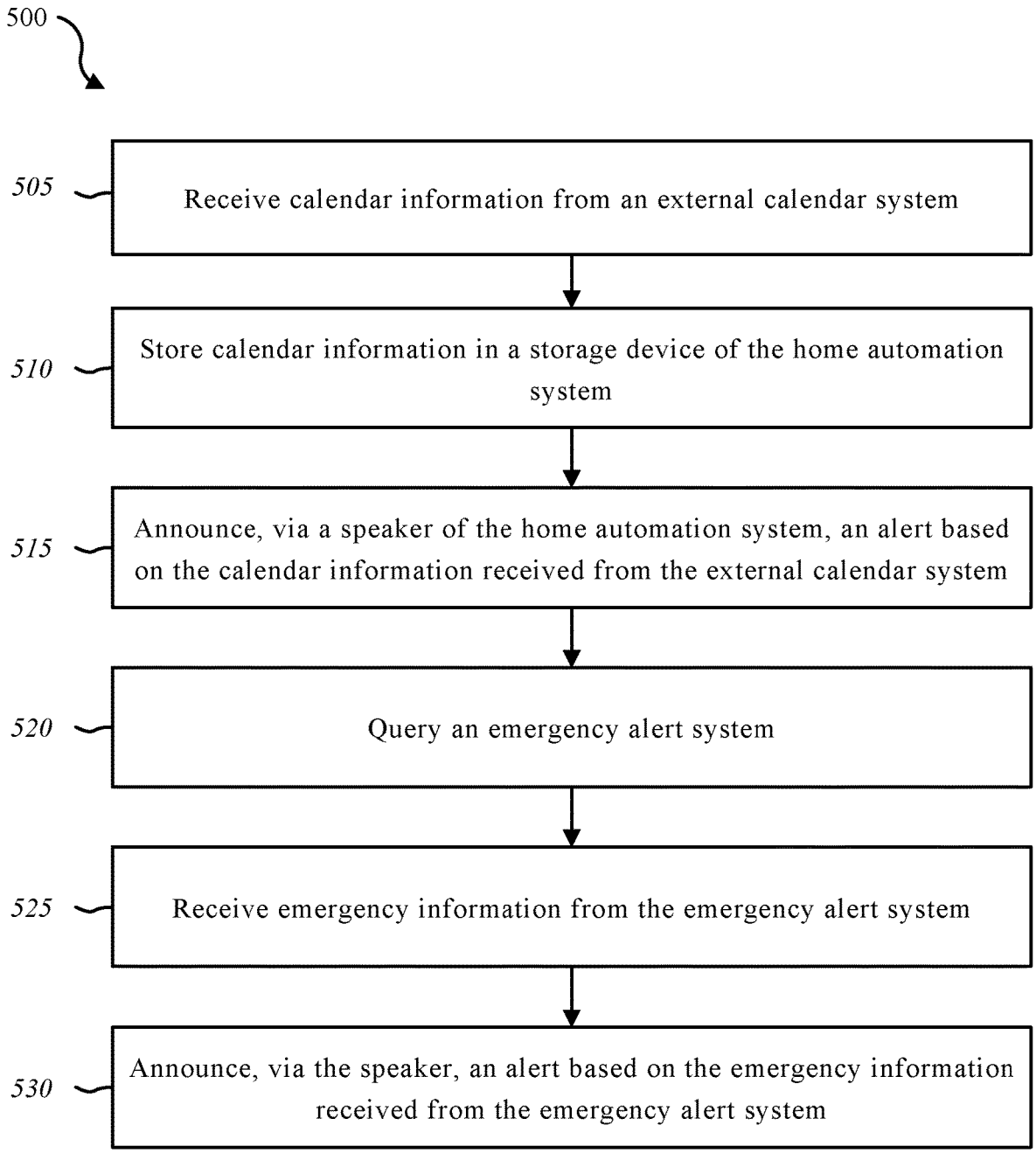
FIG. 5 is a flow diagram illustrating one embodiment of a method for announcing reminders and alerts.

FIG. 5 is a flow diagram illustrating one embodiment of a method 500 for announcing reminders and alerts. In some configurations, the method 500 may be implemented by the announcement module 145 illustrated in FIGS. 1 and/or 2. In some configurations, the method 500 may be implemented in conjunction with the application 140 and/or the user interface 135 illustrated in FIG. 1.

At block 505, calendar information may be received from an external calendar system. At block 510, calendar information may be stored in a storage device of the home automation system. At block 515, an alert based on the calendar information received from the external calendar system may be announced via the speaker. At block 520, an emergency alert system may be queried. At block 525, emergency information may be received from the emergency alert system. At block 530, an alert based on the emergency information received from the emergency alert system may be announced via the speaker.

Figure 6:
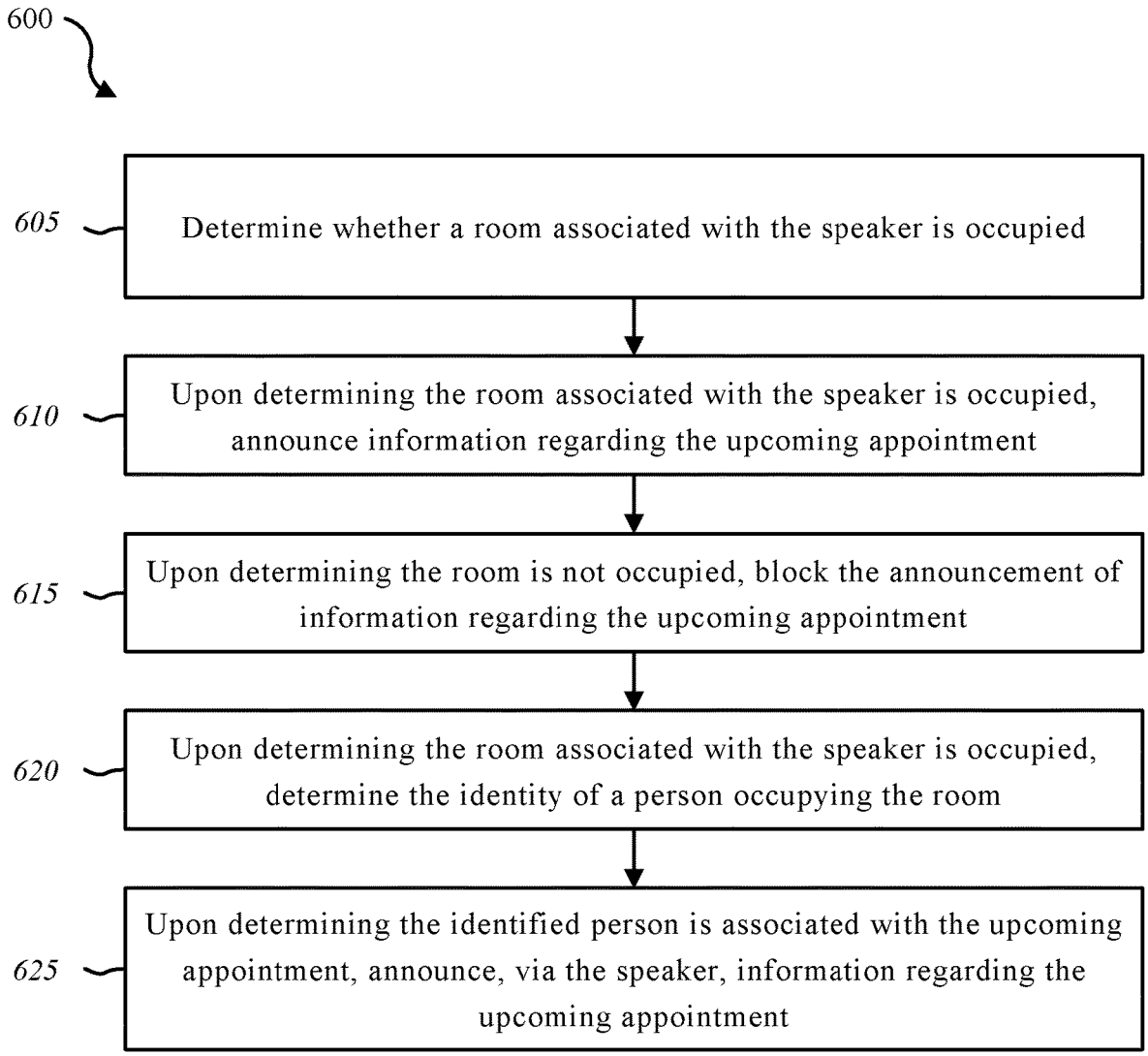
FIG. 6 is a flow diagram illustrating one embodiment of a method for making selective announcements.

FIG. 6 is a flow diagram illustrating one embodiment of a method 600 for making selective announcements. In some configurations, the method 600 may be implemented by the announcement module 145 illustrated in FIGS. 1 and/or 2. In some configurations, the method 600 may be implemented in conjunction with the application 140 and/or the user interface 135 illustrated in FIG. 1.

At block 605, it may be determined whether a room associated with the speaker is occupied. At block 610, upon determining the room associated with the speaker is occupied, information regarding the upcoming appointment may be announced via the speaker. At block 615, upon determining the room associated with the speaker is not occupied, announcement of information regarding the upcoming appointment may be blocked. At block 620, upon determining the room associated with the speaker is occupied, it may be determined the identity of a person occupying the room. At block 625, upon determining the identified person is associated with the upcoming appointment, it may be announced via the speaker, information regarding the upcoming appointment.

Figure 7:
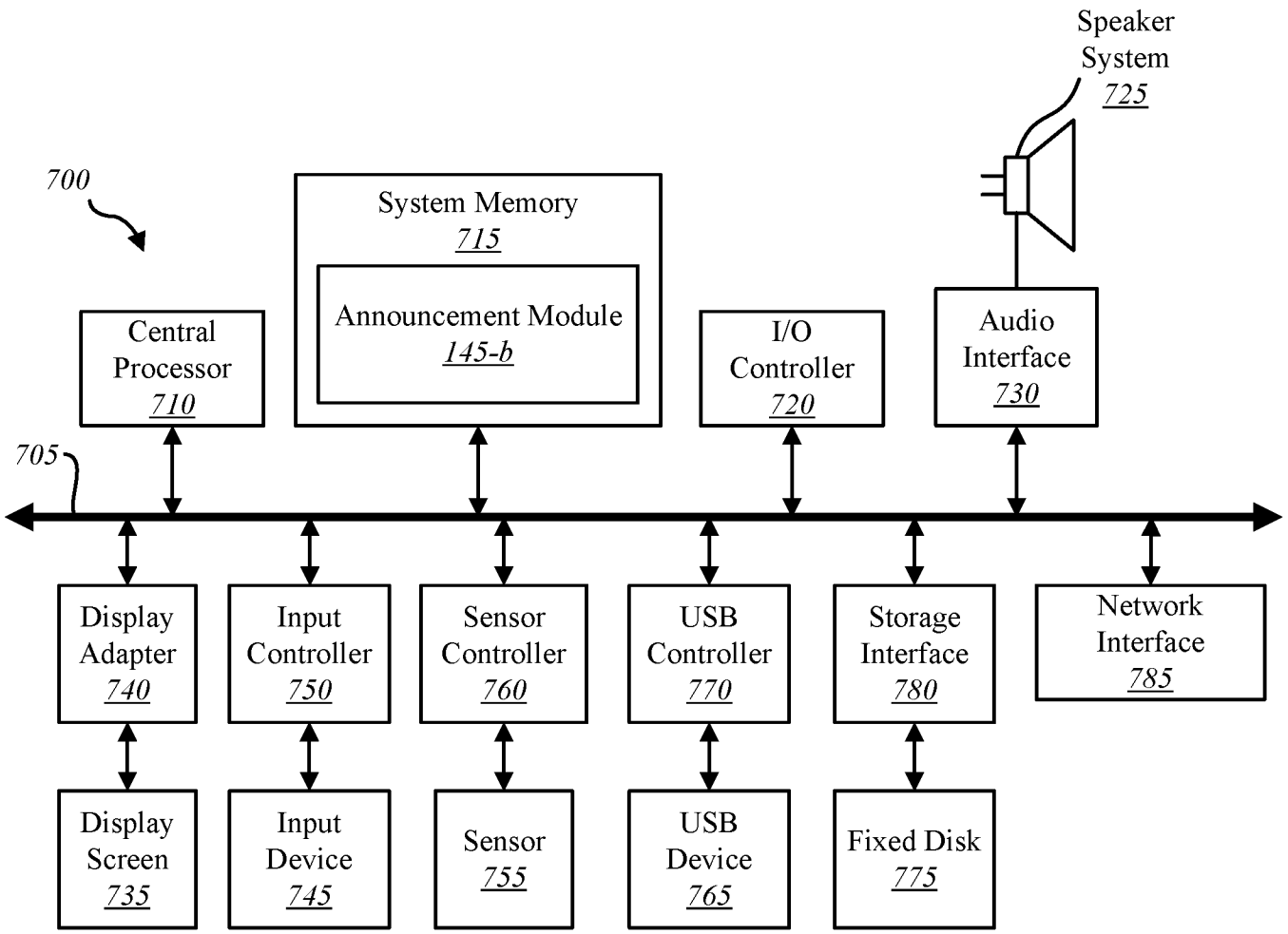
FIG. 7 depicts a block diagram of a computer system suitable for implementing the present systems and methods.

FIG. 7 depicts a block diagram of a controller 700 suitable for implementing the present systems and methods. The controller 700 may be an example of the set top box device 105, mobile computing device 150, and/or home automation controller 155 illustrated in FIG. 1. In one configuration, controller 700 includes a bus 705 which interconnects major subsystems of controller 700, such as a central processor 715, a system memory 720 (typically RAM, but which may also include ROM, flash RAM, or the like), an input/output controller 725, an external audio device, such as a speaker system 730 via an audio output interface 735, an external device, such as a display screen 735 via display adapter 740, an input device 745 (e.g., remote control device interfaced with an input controller 750), multiple USB devices 765 (interfaced with a USB controller 770), and a storage interface 780. Also included are at least one sensor 755 connected to bus 705 through a sensor controller 760 and a network interface 785 (coupled directly to bus 705).

Bus 705 allows data communication between central processor 715 and system memory 720, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components or devices. For example, the announcement module 145-*b* to implement the present systems and methods may be stored within the system memory 720. Applications resident with controller 700 are generally stored on and accessed via a non-transitory computer readable medium, such as a hard disk drive (e.g., fixed disk 775) or other storage medium. Additionally, applications can be in the form of electronic signals modulated in accordance with the application and data communication technology when accessed via interface 785.

Storage interface 780, as with the other storage interfaces of controller 700, can connect to a standard computer readable medium for storage and/or retrieval of information, such as a fixed disk drive 775. Fixed disk drive 775 may be a part of controller 700 or may be separate and accessed through other interface systems. Network interface 785 may provide a direct connection to a remote server via a direct network link to the Internet via a POP (point of presence). Network interface 785 may provide such connection using wireless techniques, including digital cellular telephone connection, Cellular Digital Packet Data (CDPD) connection, digital satellite data connection, or the like. In some embodiments, one or more sensors (e.g., motion sensor, smoke sensor, glass break sensor, door sensor, window sensor, carbon monoxide sensor, and the like) connect to controller 700 wirelessly via network interface 785.

Many other devices or subsystems (not shown) may be connected in a similar manner (e.g., entertainment system, computing device, remote cameras, wireless key fob, wall mounted user interface device, cell radio module, battery, alarm siren, door lock, lighting system, thermostat, home appliance monitor, utility equipment monitor, and so on). Conversely, all of the devices shown in FIG. 7 need not be present to practice the present systems and methods. The devices and subsystems can be interconnected in different ways from that shown in FIG. 7. The aspect of some operations of a system such as that shown in FIG. 7 are readily known in the art and are not discussed in detail in this application. Code to implement the present disclosure can be stored in a non-transitory computer-readable medium such as one or more of system memory 720 or fixed disk 775. The operating system provided on controller 700 may be iOS®, ANDROID®, MS-DOS®, MS-WINDOWS®, OS/2®, UNIX®, LINUX®, or another known operating system.

Moreover, regarding the signals described herein, those skilled in the art will recognize that a signal can be directly transmitted from a first block to a second block, or a signal can be modified (e.g., amplified, attenuated, delayed, latched, buffered, inverted, filtered, or otherwise modified) between the blocks. Although the signals of the above described embodiment are characterized as transmitted from one block to the next, other embodiments of the present systems and methods may include modified signals in place of such directly transmitted signals as long as the informational and/or functional aspect of the signal is transmitted between blocks. To some extent, a signal input at a second block can be conceptualized as a second signal derived from a first signal output from a first block due to physical limitations of the circuitry involved (e.g., there will inevitably be some attenuation and delay). Therefore, as used herein, a second signal derived from a first signal includes the first signal or any modifications to the first signal, whether due to circuit limitations or due to passage through other circuit elements which do not change the informational and/or final functional aspect of the first signal.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered exemplary in nature since many other architectures can be implemented to achieve the same functionality.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

Furthermore, while various embodiments have been described and/or illustrated herein in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may configure a computing system to perform one or more of the exemplary embodiments disclosed herein.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present systems and methods and their practical applications, to thereby enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of" In addition, for ease of use, the words "including" and "having," as used in the specification and claims, are interchangeable with and have the same meaning as the word "comprising." In addition, the term "based on" as used in the specification and the claims is to be construed as meaning "based at least upon."

What is claimed is:

1. A computer-implemented method for announcing audio data via a home automation system, the method comprising:

receiving, via a processor of the home automation system, calendar information from an external calendar system or a user interface of the home automation system;

querying, via the processor, one or more emergency alert systems based at least in part on receiving the calendar information;

receiving, via the processor, emergency information from at least one emergency alert system of the one or more emergency alert systems, wherein the received emergency information identifies earthquakes, biological emergencies, chemical emergencies, radiological emergencies, child abduction emergencies, or a combination thereof;

storing the received calendar information and the received emergency information in a storage device of the home automation system;

determining, via a module of the home automation system, an identity of a user occupying a room associated with a first speaker of one or more speakers of the home automation system, wherein the user is associated with the stored calendar information; and announcing, via the first speaker, an alert based at least in part on the received emergency information and on the determined identity of the user occupying the room.

2. The method of claim 1, further comprising:

receiving, via the processor, a request from the user to receive emergency alerts, wherein querying the one or more emergency alert systems is based at least in part on receiving the request.

3. The method of claim 1, further comprising:

detecting, via a module of the home automation system, conditions associated with a home or building based at least in part on querying the one or more emergency alert systems, wherein the received emergency information further identifies the detected conditions.

4. The method of claim 3, wherein the detected conditions comprise a fire alarm, flooding, a carbon monoxide level, an appliance failure, one or more temperature anomalies, or a combination thereof.

5. The method of claim 1, wherein the received emergency information further identifies weather conditions, traffic conditions, or a combination thereof.

6. The method of claim 1, further comprising:

receiving, at the first speaker of the one or more speakers, the emergency information; and storing the emergency information in a storage device at the first speaker.

7. The method of claim 1, further comprising:

determining, via a module of the home automation system, whether a second room associated with a second speaker of the one or more speakers is occupied.

8. The method of claim 7, further comprising:

upon determining the second room associated with the second speaker is occupied, announcing, via the second speaker, the alert based at least in part on the received emergency information.

9. The method of claim 7, further comprising:

upon determining the second room associated with the second speaker is not occupied, blocking the announcement of the alert.

10. A home automation system configured to announce audio data, comprising:

a processor;

one or more speakers;

a detection module;

memory in electronic communication with the processor; and instructions stored in the memory, the instructions being executable by the processor to:

receive calendar information from an external calendar system or a user interface of the home automation system;

query one or more emergency alert systems based at least in part on receiving the calendar information;

receive emergency information from at least one emergency alert system of the one or more emergency alert systems, wherein the received emergency information identifies earthquakes, biological emergencies, chemical emergencies, radiological emergencies, child abduction emergencies, or a combination thereof;

store the received calendar information and the received emergency information in a storage device of the home automation system;

determine, via the detection module, an identity of a user occupying a room associated with a first speaker of the one or more speakers, wherein the user is associated with the stored calendar information; and announce, via the first speaker, an alert based at least in part on the received emergency information and on the determined identity of the user occupying the room.

11. The home automation system of claim 10, wherein the instructions are further executable by the processor to:

receive a request from the user to receive emergency alerts, wherein querying the one or more emergency alert systems is based at least in part on receiving the request.

12. The home automation system of claim 10, wherein the instructions are further executable by the processor to:

detect, via the detection module, conditions associated with a home or building based at least in part on querying the one or more emergency alert systems, wherein the received emergency information further identifies the detected conditions.

13. The home automation system of claim 12, wherein the detected conditions comprise a fire alarm, flooding, a carbon monoxide level, an appliance failure, one or more temperature anomalies, or a combination thereof.

14. The home automation system of claim 10, wherein the instructions are further executable by the processor to:

determine, via the detection module, whether a second room associated with a second speaker of the one or more speakers is occupied.

15. The home automation system of claim 14, wherein the instructions are further executable by the processor to:

upon determining the second room associated with the second speaker is occupied, announce, via the second speaker, the alert based at least in part on the received emergency information.

16. The home automation system of claim 14, wherein the instructions are further executable by the processor to:

upon determining the second room associated with the second speaker is not occupied, block the announcement of the alert.

17. A non-transitory computer-readable medium storing computer-executable code for a home automation system, the code executable by a processor to:

receive, via the processor, calendar information from an external calendar system or a user interface of the home automation system;

query, via the processor, one or more emergency alert systems based at least in part on receiving the calendar information;

receive, via the processor, emergency information from at least one emergency alert system of the one or more emergency alert systems, wherein the received emergency information identifies earthquakes, biological emergencies, chemical emergencies, radiological emergencies, child abduction emergencies, or a combination thereof;

store the received calendar information and the received emergency information in a storage device of the home automation system;

determine, via a module of the home automation system, an identity of a user occupying a room associated with a first speaker of one or more speakers of the home automation system, wherein the user is associated with the stored calendar information; and announce, via the first speaker, an alert based at least in part on the received emergency information and on the determined identity of the user occupying the room.

18. The non-transitory computer-readable medium of claim 17, wherein the code is further executable by the processor to:

receive, via the processor, a request from the user to receive emergency alerts, wherein querying the one or more emergency alert systems is based at least in part on receiving the request.

19. The non-transitory computer-readable medium of claim 17, wherein the code is further executable by the processor to:

detect, via a module of the home automation system, conditions associated with a home or building based at least in part on querying the one or more emergency alert systems, wherein the received emergency information further identifies the detected conditions.

* * * * *